US005924963A

United States Patent [19]

Maresh et al.

[11] Patent Number: 5,924,963

[45] Date of Patent: Jul. 20, 1999

[54] EXERCISE METHODS AND APPARATUS

[76] Inventors: Joseph D. Maresh, P.O. Box 645, West Linn, Oreg. 97068-0645; Kenneth W. Stearns, P.O. Box 55912, Houston, Tex. 77055

[21] Appl. No.: 09/156,279

[22] Filed: Sep. 17, 1998

[51] Int. Cl.[6] ..... A63B 22/00; A63B 69/16

[52] U.S. Cl. ..... 482/57; 482/51; 482/52

[58] Field of Search ..... 482/51, 52, 53, 482/57, 70, 79, 80, 62

[56] References Cited

U.S. PATENT DOCUMENTS

| | | | |
|---|---|---|---|
| 5,499,956 | 3/1996 | Habing et al. | 482/51 |
| 5,577,985 | 11/1996 | Miller | 482/52 |
| 5,611,756 | 3/1997 | Miller | 482/57 |
| 5,733,227 | 3/1998 | Lee | 482/52 |
| 5,769,760 | 6/1998 | Lin et al. | 482/51 |
| 5,846,166 | 12/1998 | Kuo | 482/70 |

*Primary Examiner*—Stephen R. Crow

[57] ABSTRACT

An exercise apparatus includes a crank rotatably mounted on a frame; a connector link having an intermediate portion rotatably connected to the crank; a foot platform rotatably connected to an upper end of the connector link; a rocker link rotatably connected to a lower end of the connector link; a control link rotatably interconnected between the foot platform and the rocker link; and a handle bar link rotatably mounted on the frame and movably connected to the rocker link.

4 Claims, 3 Drawing Sheets

Prior Art

EXERCISE METHODS AND APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical.

Several elliptical motion exercise machines are disclosed in U.S. Pat. No. 5,707,321 to Maresh (the inventor of the present invention). Generally speaking, the Maresh patent discloses an exercise apparatus having a first portion of a connector link rotatably connected to a crank; a second portion of the connector link rotatably connected to a rocker link; and a third portion of the connector link rotatably connected to a foot support. As the crank rotates, the linkage assembly constrains the foot support to travel through a generally elliptical path. Some of the embodiments (including those shown in FIGS. 5–7) include arrangements for controlling the orientation of the foot support throughout the exercise motion. The Maresh patent also discloses that arm exercise members may connected to the linkage to facilitate contemporaneous exercise of the lower and upper body.

Another, more recent prior art exercise machine is designated as 300 in FIG. 3. The machine 300 includes a frame 310 and a foot supporting linkage assembly 303 movably mounted on the frame 310. The frame 310 includes a base 311 designed to rest upon a floor surface; a relatively rearward stanchion 312 extending upward and forward from the base 311; and a forward stanchion 313 extending upward from the base 311 and joined the rearward stanchion 312.

The linkage assembly 303 includes left and right cranks 320 rotatably mounted to the rearward stanchion 312 and thereby defining crank axis A'. Left and right intermediate links 330 have intermediate portions rotatably connected to distal ends of respective cranks 320, thereby defining respective pivot axes B'. First ends of the links 330 are rotatably connected to intermediate portions of respective left and right foot supports 340, thereby defining respective pivot axes C'. Opposite, second ends of the links 330 are rotatably connected to rearward ends of respective left and right rocker links 360, thereby defining respective pivot axes D'. Opposite, forward ends of the rocker links 360 are rotatably connected to the forward stanchion 313, thereby defining a common pivot axis E'. The foregoing features of the linkage assembly 303 are identical to embodiments disclosed in the Maresh patent. In order to control the orientation of the foot supports 340, left and right control links 350 are rotatably interconnected between the forward ends of respective foot supports 340 and intermediate portions of respective rocker links 360.

The present invention seeks to improve upon the prior art device 300 and/or the exercise machines disclosed in the Maresh patent.

SUMMARY OF THE INVENTION

The present invention provides an exercise apparatus which combines elliptical foot motion and arcuate hand motion. Many features of the present invention will become apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
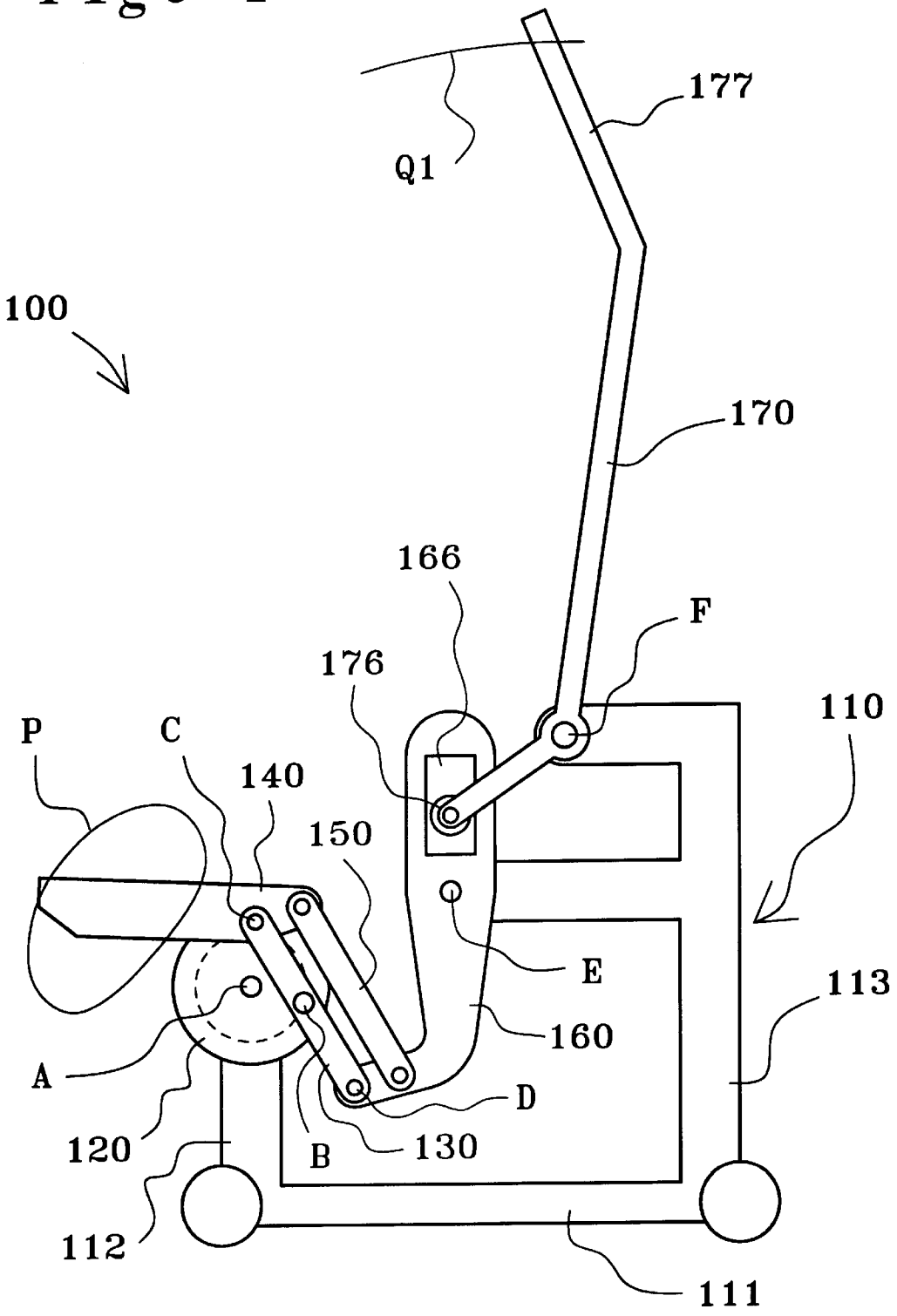
FIG. 1 is a side view of a first exercise apparatus constructed in accordance with the present invention.

A preferred embodiment of the present invention is designated as 100 in FIG. 1. The exercise apparatus 100 includes a frame 110 and a linkage assembly movably mounted on the frame 110. The frame 110 includes a base 111 designed to rest upon a floor surface; a rearward stanchion 112 extending upward from the base 111; and a forward stanchion 113 extending upward from the base 111.

The linkage assembly includes left and right cranks 120 rotatably mounted to the rearward stanchion 112 and thereby defining crank axis A. Left and right intermediate links 130 have intermediate portions rotatably connected to distal ends of respective cranks 120, thereby defining respective pivot axes B. As a result of this arrangement, each pivot axis B is constrained to rotate at a fixed radial distance about the crank axis A.

First ends of the intermediate links 130 are rotatably connected to respective left and right foot supports 140, thereby defining respective pivot axes C. As a result of this arrangement, each pivot axis C is constrained to pivot at a fixed radial distance about a respective pivot axis B. Opposite, second ends of the intermediate links 130 are rotatably connected to lower ends of respective left and right rocker links 160, thereby defining respective pivot axes D. An intermediate portion of each rocker link 160 is rotatably connected to a relatively lower trunnion on the forward stanchion 113, thereby defining common pivot axis E. As a result of this arrangement, the pivot axes D are constrained to pivot at a fixed radial distance about the common pivot axis E.

Upper ends of left and right control links 150 are rotatably connected to respective foot supports 140, forward of respective pivot axes C. Opposite, lower ends of the control links 150 are rotatably connected to respective rocker links 160, forward of respective pivot axes D. The control links 150 extend parallel to the intermediate links 130.

Upper ends of the rocker links 160 are provided with respective races or slots 166. Left and right rollers 176 are rotatably connected to lower ends of respective handle bar links 170 and are disposed within respective slots 166. An intermediate portion of each handle bar link 170 is rotatably connected to a relatively higher trunnion on the forward stanchion 113, thereby defining a common pivot axis F. An upper end 177 of each handle bar link 170 is sized and configured for grasping by a person standing on the foot supports 140.

As a result of the foregoing interconnections, rotation of the cranks 120 is linked to movement of the foot supports 140 through the generally elliptical path P and pivoting of the handles 177 through the arcuate paths Q1.

Figure 2:
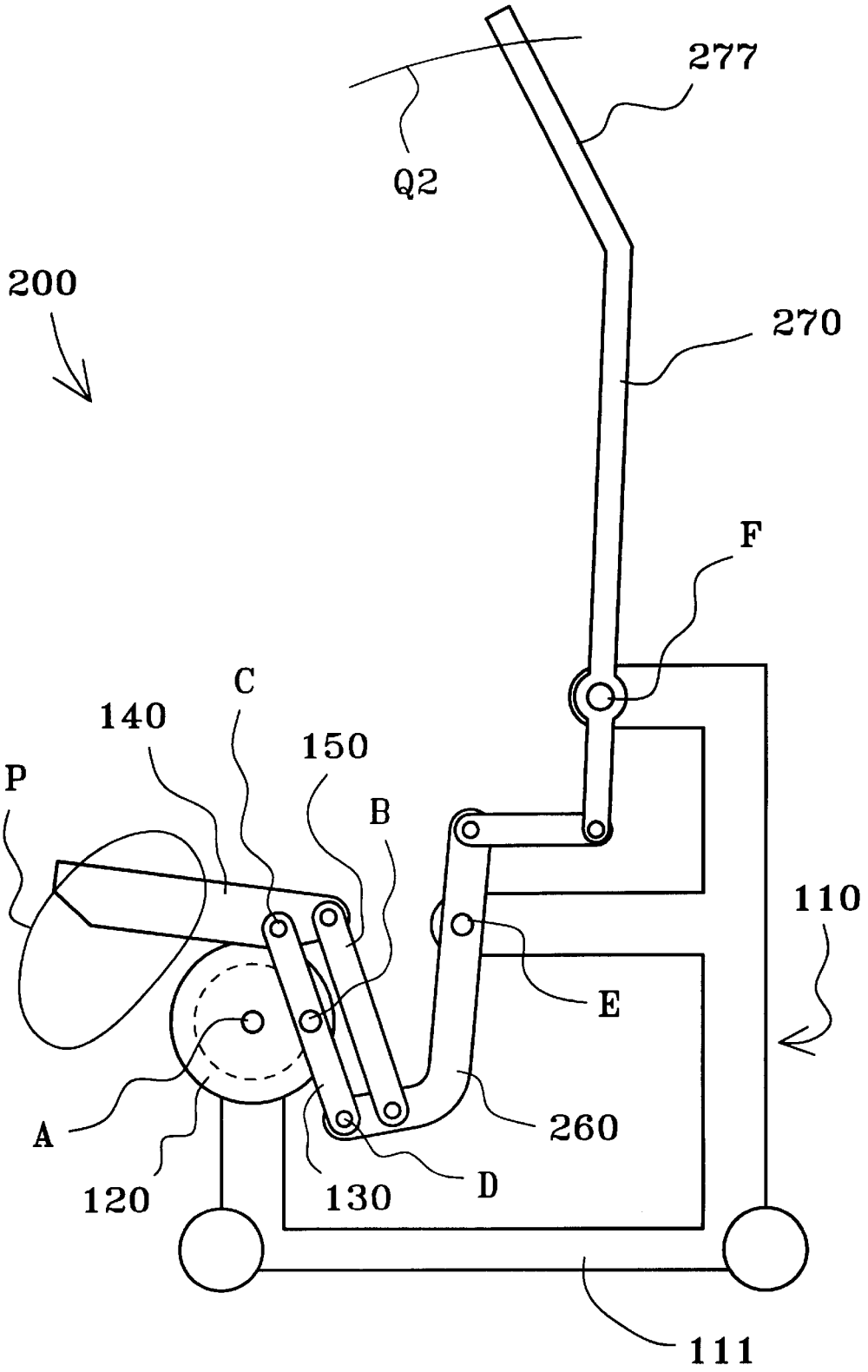
FIG. 2 is a side view of a second exercise apparatus constructed in accordance with the present invention.
Figure 3:
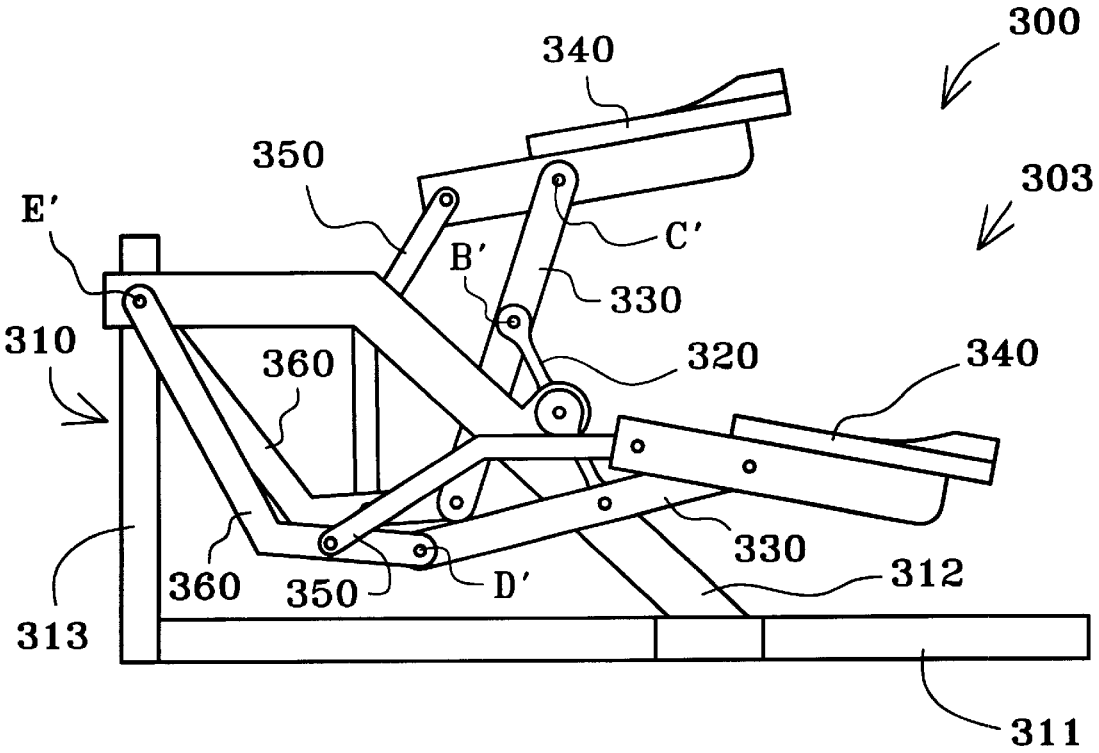
FIG. 3 is a side view of a prior art exercise apparatus.

An alternative embodiment of the present invention is designated as 200 in FIG. 2. The exercise apparatus 200 includes the same frame 110 and a somewhat different linkage assembly movably mounted on the frame 110. The frame 110 includes a base 111 designed to rest upon a floor surface; a rearward stanchion 112 extending upward from the base 111; and a forward stanchion 113 extending upward from the base 111.

The linkage assembly includes comparable left and right cranks 120 rotatably mounted to the rearward stanchion 112 and thereby defining crank axis A. Comparable left and right intermediate links 130 have intermediate portions rotatably connected to distal ends of respective cranks 120, thereby defining respective pivot axes B. As a result of this arrangement, each pivot axis B is constrained to rotate at a fixed radial distance about the crank axis A.

First ends of the intermediate links 130 are rotatably connected to respective left and right foot supports 140 (like those on the preferred embodiment 100), thereby defining respective pivot axes C. As a result of this arrangement, each pivot axis C is constrained to pivot at a fixed radial distance about a respective pivot axis B. Opposite, second ends of the intermediate links 130 are rotatably connected to lower ends of respective left and right rocker links 260 (different than those on the preferred embodiment 100), thereby defining respective pivot axes D. An intermediate portion of each rocker link 260 is rotatably connected to a relatively lower trunnion on the forward stanchion 113, thereby defining common pivot axis E. As a result of this arrangement, the pivot axes D are constrained to pivot at a fixed radial distance about the common pivot axis E.

Upper ends of left and right control links 150 are rotatably connected to respective foot supports 140, forward of respective pivot axes C. Opposite, lower ends of the control links 150 are rotatably connected to respective rocker links 260, forward of respective pivot axes D. The control links 150 extend parallel to the intermediate links 130.

Upper ends of the rocker links 260 are rotatably connected to rearward ends of respective left and right rigid links 267. Lower ends of left and right handle bar links 270 are rotatably connected to forward ends of respective rigid links 267. An intermediate portion of each handle bar link 270 is rotatably connected to a relatively higher trunnion on the forward stanchion 113, thereby defining a common pivot axis F. An upper end 277 of each handle bar link 270 is sized and configured for grasping by a person standing on the foot supports 140.

As a result of the foregoing interconnections, rotation of the cranks 120 is linked to movement of the foot supports 140 through the generally elliptical path P and pivoting of the handles 277 through the arcuate paths Q2.

Recognizing that the foregoing description will enable those skilled in the art to derive additional modifications and/or variations, the present invention is to be limited only to the extent of the claims which follow.

What is claimed is:

1. An exercise apparatus, comprising:

a base designed to occupy a fixed position relative to a floor surface;

a left crank and a right crank, wherein each said crank is rotatably connected to said base at a common crank axis;

a left rocker link and a right rocker link, wherein each said rocker link has an intermediate portion rotatably connected to said base at a common rocker axis;

a left connector link and a right connector link, wherein each said connector link has an upper end, and an intermediate portion rotatably connected to a respective crank, and a lower end rotatably connected to a lower end of a respective rocker link;

a left foot support and a right foot support, wherein each said foot support is rotatably connected to said upper end of a respective connector link;

a left control link and a right control link, wherein each said control link has an upper end rotatably connected to a respective foot support, and a lower end rotatably connected to a respective rocker link;

a left handle bar link and a right handle bar link, wherein each said handle bar link has an intermediate portion rotatably connected to said base at a common pivot axis, and a lower end movably connected to a respective rocker link, and an upper end sized and configured for grasping.

2. The exercise apparatus of claim 1, wherein a left roller is rotatably mounted on said lower end of said left handle bar link, and a right roller is rotatably mounted on said lower end of said right handle bar link, and each said roller is disposed inside a race provided on an upper end of a respective rocker link.

3. The exercise apparatus of claim 1, wherein a left rigid link is rotatably interconnected between said left handle bar link and said left rocker link, and a right rigid link is rotatably interconnected between said right handle bar link and said right rocker link.

4. The exercise apparatus of claim 1, wherein each said control link is disposed forward of a respective connector link and extends parallel thereto.

* * * * *